United States Patent [19]

Reuting

[11] 3,947,792

[45] Mar. 30, 1976

[54] ELECTROMAGNETIC RELAY

[75] Inventor: Hans-Werner Reuting, Peine, Germany

[73] Assignee: Elmeg Elektro-Mechanik GmbH, Peine, Germany

[22] Filed: Sept. 3, 1974

[21] Appl. No.: 502,802

[30] Foreign Application Priority Data

Sept. 3, 1973 Germany ..... 2344365

[52] U.S. Cl. ..... 335/201; 200/147 A

[51] Int. Cl.[2] ..... H01H 9/30

[58] Field of Search ..... 335/201; 200/147 A

[56] References Cited

UNITED STATES PATENTS

| | | | |
|---|---|---|---|
| 2,611,059 | 9/1952 | Immel et al. | 200/147 A |
| 2,875,301 | 2/1959 | Immel | 200/147 A |
| 2,875,302 | 2/1959 | Immel et al. | 200/147 A |
| 2,875,303 | 2/1959 | Immel et al. | 200/147 A |
| 3,376,401 | 4/1968 | Bazi et al. | 200/147 A |
| 3,688,230 | 8/1972 | Tichy | 335/201 |

*Primary Examiner*—Harold Broome

*Attorney, Agent, or Firm*—Ralf H. Siegemund

[57] ABSTRACT

A relay is constructed to have movable contacts on flat contact carriers extending e.g. from a swivel armature and moving in a space between corresponding flat yoke legs. The contacts on the carrier cooperate with fixed but resiliently mounted contacts. The carriers have permanent magnets to obtain magnetic blowing of any arc, and air flow around the carrier is confined to run transverse thereto also across the carrier contact surfaces. Both actions on the arc extend transverse to the direction of carrier movement upon relay actuation.

12 Claims, 1 Drawing Figure

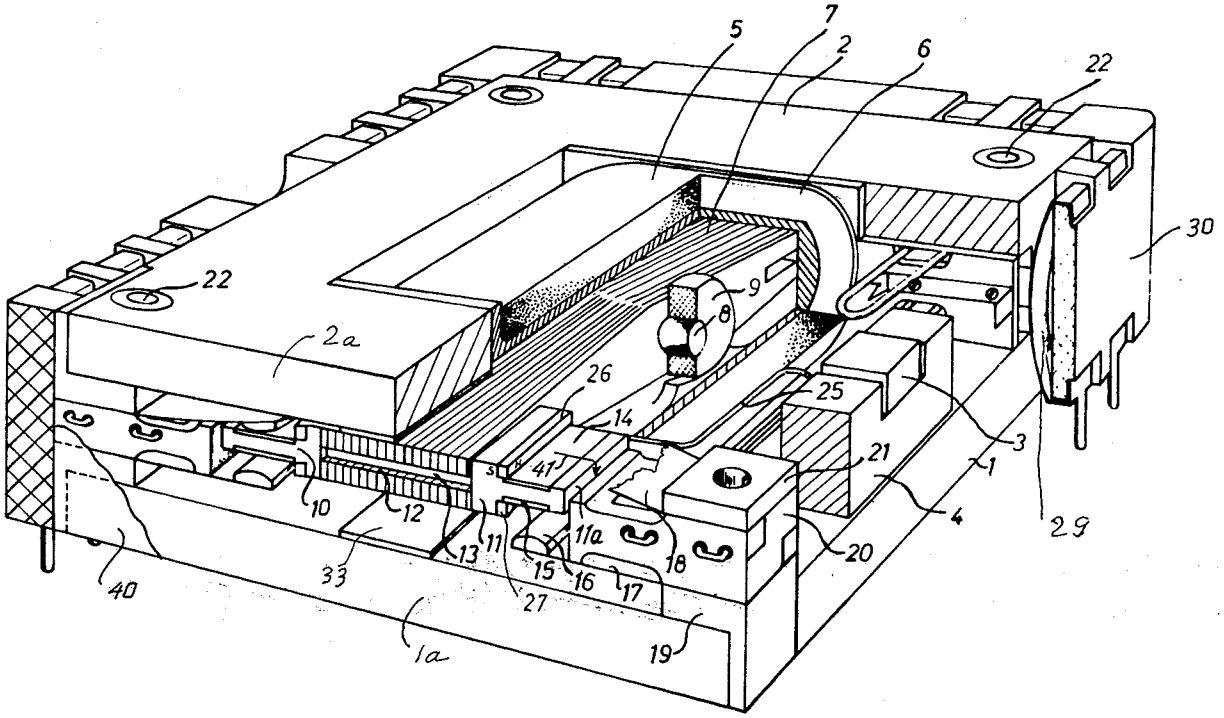
30
22
29
3
1
4
6
7
2
5
21
20
25
9
8
18
19
17
14
26
11a
16
15
27
47
11
13
12
1a
33
2a
10
22
40

ELECTROMAGNETIC RELAY

BACKGROUND OF THE INVENTION

The invention relates to an electromagnetic relay with moving contacts which are operated by an armature and cooperate with fixed contacts.

Practically all kinds of electromagnetic relays are constructed in such a way that an armature in the form of a pivoting armature, rotating armature or the like, is operated electromagnetically, thereby causing displacement of contacts which, for example, disengage or engage corresponding fixed contacts. Moving contacts as well as fixed contacts are usually mounted on contact springs. To this end, moving contacts can be operated by operating bridges or the like which are influenced by the armature.

Opening the contacts in all such relays, particularly those adapted for switching high power, results in an arc as a result of which the contact surfaces are destroyed. Such a destruction of the contacts also substantially reduces the service life of the relays because, on the one hand, contacts with a destroyed surface no longer reliably provide an adequately low transfer or contact resistance and, on the other hand, contact burning also influences all the other operating values of the relay to a substantial extent. For example, the contact pressure of burned contacts is reduced. Moreover, the springs of burnt contacts store less energy so that the armature motion which is effected or influenced by the spring force is slowed down and, depending on the construction, causes slower contact opening speeds and accordingly increased contact burning or involves other disadvantages.

Arcing between opening contacts of a relay rapidly renders such a relay useless, particularly if the spark gap is maintained for a prolonged period and carries a heavy current. Contact burning of this kind can be retarded to a certain extent by using high-grade contact material. There are naturally limits to this procedure, so that the service life of a relay and its reliability depends in the first place on the extent to which it is possible to avoid prolonged, severe arcing between opening contacts. Advantages in this and other respects are obtained by encapsulating the entire relay or at least the contacts in a protective atmosphere, but this procedure is costly and therefore not always possible.

DESCRIPTION OF THE INVENTION

The object of the present invention is to provide an electromagnetic relay in which contact burning is substantially reduced in a simple manner.

According to the preferred embodiment of the present invention it is suggested to improve an electromagnetic relay having moving contacts actuated by an armature and cooperating with fixed contacts in that a magnetic flux path is established which extends perpendicularly to the direction of motion of the contacts and parallel to the contact surfaces and that the magnetic flux is effective at least while the moving contacts are in motion. A magnetic flux of this kind applies a force on an arc between opening contacts, which force extends parallelly to the contact surfaces and perpendicularly to the direction of contact motion as well as to the direction of flux, so that an arc of this kind is moved over the contact surfaces and does not remain at specific places. Contact erosion on the contact surfaces through arcing is thus substantially reduced, and the service life of the relay prolonged because any spot on the contact surfaces are considerably less extensively heated by the arc. Appropriately, the magnetic flux is perpendicular to the contact lines when linear contacts are used. In this way the magnetic flux forces an arc to travel along the contact lines. This can be readily achieved because the distance between the contact lines of opposing contacts is and remains always uniform.

The flux can be generated in different ways, still incorporating specific principles of the invention. For example, permanent magnets may be used or the flux can be generated by electric energization to obtain magnetic blowing force, which displaces a spark or an electric arc in the manner described above. One appropriate embodiment of the invention provides that a permanent magnet or a magnetically conductive member is associated with the armature and/or the moving contacts and produces a flux component which extends in the stated direction.

The present invention also provides either solely or in conjunction with the provision of means for displacing an arc that the armature and/or the moving contacts or elements supporting the same are constructed in sufficiently broad form and are arranged together with the fixed contacts, so that motion of the moving contacts produces an airflow for cooling and for reducing the plasma between the opening moving and fixed contacts. A powerful airflow of this kind also substantially counteracts the production of a spark or an electric arc and its continued establishment.

To generate such a powerful airflow, the invention appropriately provides that the moving contacts are mounted as contact surfaces on contact carrier members which are rigidly coupled to the relay armature at the end thereof, and the air space above and below the armature end and the contact carrier member is closed towards the top and bottom. In this way the air displaced as a result of armature motion on one side of the armature and of the carrier members is utilized mainly for compensating the low air pressure which is produced on the receding side of the armature and of the contact carrier member as displaced. Since the air space at the top and bottom is closed, such compensation cannot be obtained from the ambient air as this would result in some circumstances in there being either no airflow or only a slight airflow parallel to the contact surfaces.

In order to obtain a further increase of such an airflow which is parallel to the contact surfaces, it is advantageous if the air space above and below the armature end and of the contact carrier members is closed substantially to all sides, with the exception of one side, and in such a way that armature motion is accompanied by air compensation flow which is confined to flow spaces above or below the armature and between top or bottom sides of the armature and of the contact carrier member and here substantially only to the free side of the contact carrier. This ensures that the air compensation flow from one side of the armature and associated carrier members to the other side thereof takes place substantially in only one or two analogous flow directions, so that a powerful flow is produced in a specific direction parallel to the contact surfaces in each instance. Flow of this kind naturally cools an electric arc or spark particularly extensively and also dilutes the plasma required for maintaining a spark or electric arc to a particularly marked extent. To this end the side which is distal with respect to the armature is advantageously left free for air compensation, because this provides the longest possible path and, therefore, the greatest possible air velocity for the compensation flow of air from one side to the other. Accordingly, this also results in optimum "blowout" of an electric arc or spark.

When using elongated contacts, for example, linear contacts, these are appropriately and advantageously aligned so that their longitudinal extension is orientated in the direction of the side which is left free for air compensation. Elongated contacts of this kind close the air space on the entire afore-mentioned side for as long as the contacts are closed and provide for a particularly powerful suction flow of air at the moment at which the contacts are open. A strong airflow will blow almost exclusively between the lines of contact and being thus utilized almost entirely for cooling the contact surfaces and for diluting the plasma of the opening arc. Since the arc of such elongated contacts is displaced in the direction of the longitudinal extension of the contacts by virtue of the magnetic flux provided to this end, it follows that the air stream which passes perpendicularly to the longitudinal extension of the contacts produces particularly powerful dilution of the plasma which maintains the spark gap, because the velocity of airflow is added geometrically to the speed of the spark or electric arc as it is magnetically blown in the lateral direction. Given this flow direction, the air will cool the appropriate space more effectively than would be the case if the air flowed in the direction of the travelling arc because in this case the airflow would be extensively heated by the arc in the critical region. Given such airflow, the plasma would also be detrimentally displaced towards the travelling arc.

If the moving contacts are constructed as contact surfaces on contact carrier members which are associated with the armature, the permanent magnet or magnets are mounted on the contact carrier members directly adjacent to the contact surfaces in order to produce the desired magnetic flux for displacing the arc. This enables a particularly powerful flux component to be produced parallelly to the contact surfaces. The magnetic flux can flow to yokes or pole pieces which are required for operation of the relay and are positioned at the top and bottom, or the flux can flow to pole surfaces which are specially provided to this end. Instead of permanent magnets one can use magnetically conductive members constructed for mounting the contact carrier member to the armature. In this way the contact carrier members are mounted by the same element which produces a flux for acting on the spark gap without requiring any additional expenditure.

A particularly simple construction airflow provides for control without additional expenditure, if the air space above and below the armature end and above and below the contact carriers is closed at the top and bottom by two correspondingly wide yokes which extend in the direction of the drive members in this region and are associated with the relay assumed to be provided with a rotating armature. No additional expenditures is therefore required for confining the air space at the top and bottom because such confining is already provided by the yokes which are in any case required. Even better guiding of the airflow is obtained in a simple and appropriate manner by lateral bounding of the air space between the two yokes in the zone thereof through connecting surfaces between the said yokes. Connecting surfaces of this kind may be obtained by simple adhesive foil which is provided between the yokes or by encapsulation of the relay.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

The FIGURE is a perspective view of a bistable polarized retentive relay in which some parts are shown in sectioned form in the interests of clarity.

Proceeding now to the detailed description of the drawings, the relay illustrated has two quadrilateral yokes 1 and 2, which could be regarded as rings or annuloids of rectangular contour, each yoke having four legs accordingly. A permanent magnet 3 and an intermediate piece 4 is disposed between two adjacent legs of yokes 1 and 2, there being a corresponding assembly interposed between the two oppositely located legs of the two yokes. These intermediate pieces 4 function as spacers and are quite accurately machined. The same is true for the magnets 3, so that the distance between the two yokes 1 and 2 is accurately determined therewith.

A bobbin or coil carrier 6 is disposed in the open space in and as between the central portions of yokes 1 and 2; this carrier 6 carries an energizing coil 5, while a pivoting armature 7 is disposed inside of bobbin 6. Armature 7 has a shaft or axle 8 for journalling the armature in plastic aperture disks 9. These disks are mounted in carrier 6. The armature 7 can pivot in one or the opposite direction and its extremeties or arm ends can engage diagonally opposed yoke legs, serving as pole-shoes accordingly.

As all parts are circumscribed by the yokes, they can generally be made relatively wide, especially in the region of the permanent magnets, so that the thickness of the latter which must be of a definite volumetric capacity, can be kept relatively small. This offers a number of significant advantages; among them is that these permanent magnets may have a relatively low magnetic internal resistance, which is important from the point of view of increasing the sensitivity of the relay. Since the permanent magnets are actually situated in the magnetic circuit of the excitation flux, that flux would have to be made greater in proporation to any increase in the magnetic resistance in the magnetic circuit.

The gap between the two yokes needs only be partly filled by the flat permanent magnet 3, the remainder being occupied by soft iron parts 4. In such a case, the thickness of the permanent magnets and that of the soft iron parts determines the spacing between the yokes 1 and 2. In view of the ample space made available by the use of wide yokes, the soft iron parts may in this case be designed so as to form a magnetic shunt; by this means the smallest possible magnet volume and the lowest possible internal resistance of the permanent magnet system situated between the yokes may be arrived at for a given relay by suitable optimization.

The two ends of armature 7 each carry two laterally extending contact carriers 10 and 11, made e.g. of plastic material. These carriers are secured to the respective armature arm by means of a magnetizable rod or bar 13, which is inserted in a slot 12 at the particular armature end. Each of the carriers 10 and 11 has a contact surface 14 on its respective upper or top side, and another contact surface 15 on its lower side. Hence, these contact surfaces are moved up and down on pivot motion by the armature 7 and constitute non-captive contacts. The entire arrangement has eight such contact surfaces, the sub-assembly as illustrated in the front of the perspective illustration is dublicated in the rear.

Each contact surface on the rocking or pivoting armature cooperates with a stationary contact 16 having curved, cylindrical contour as facing the respective armature contact. Contacts 16 are stationary in the sence that they are not mounted on the armature, but they are displaceable due to mounting on leaf springs, such as 17. A leaf spring 18 is shown partially, carrying also a contact, such as 16, which cooperates with a contact surface 14 on an upswing of the armature.

Due to the swivel, pivot or rocking motion and displacement of the armature, one arm of the armature will deflect two springs 17, while the other arm deflects two springs 18, with a reversal of deflection action on pivoting to the respective other position. The illustrated position of the armature shows the end which is visible in the front due to perspective illustration, in up position, so that contact carriers 10, 11 deflect the two visible springs 18. The rear end of the armature is down accordingly and has deflected the two springs corresponding to 17. Each armataure end does not abut a yoke leg directly, but sits on a stop sheet 33.

The relay has four corner assemblies, one assembly being shown in greater detail and being comprised of spacer pieces 19, 20 and 21. These leaf springs 17 and 18 are secured to these spacer assemblies. These assemblies actually serve as mounting structures in that rivets, such as 22, hold spacer assemblies and yokes together in the four corners. The springs are mounted with the assembly in that fashion and the rivets force super-imposed parts together. Not all of the spacers 19, 20, 21, springs 17, 18 and yokes 1 and 2 have all of the illustrated recesses and protrusions in all four corners.

Each contact surface 14 and 15 is connected to an elongated spring, such as 25, running parallel to the armature and providing current to the respective contact surfaces. The spring doubles back and is run to the outside through the respective, associated corner piece 20.

The ends of contact springs 17 and 18 as well as of springs 25 are constructed to lead to connections in and at the respective closest corner element 20. These connections may be connected to or engage springs 29 of a plug connector 30. The connector 30 is constructed as a frame into which the entire relay yoke structure has been inserted. The springs 29 are equipped with soldering pins or lugs 31, which can be soldered onto a printed circuit board.

The plug connector 30 is constructed as a frame and has adequate dimensions for receiving the yokes as riveted together. The height of depth of that frame should not exceed the height of the yoke assembly. This way, no additional head room has to be provided for, the frame 30 as circumscribing the yoke assembly encases the yoke assembly and the top and bottom opening of the yoke structure may be covered by a thin foil. The yoke assembly may be just stuck into the frame, and two of its sides cover the laterally open space between those yoke legs which serve as pole shoes. Two opposite sides of frame 30 have recesses 32, so that the yokes as assembled can be gripped by at least one yoke, so that the yoke assembly can be removed from the frame.

The legs of the yoke themselves cover all contact-making parts of the relay and are relatively wide. This wide construction does not only serve as protection, but the permanent magnets 3 may also have very large base surfaces and offer, therefore, very small internal resistance (reluctance). As stated, the magnetizable spacers 4 provide for a magnetic shunt path which reduces the magnetic resistance regarding energizing flux still further, while the volume of magnetized material is quite small. The sensitivity of the relay benefits greatly from this feature.

Each carrier 10 and 11 has additionally two permanent magnetics 26 and 27 providing one magnetic flux component in direction of the respective contact surfaces 14 and 15. These particular flux components establish a force acting on an arc or spark between a contact surface on the one hand and in direction of longitudinal extension of that counter contact so as to drive the spark in axial direction as far as the cylindrical contour of the contact 16 is concerned. Therefore, such an arc will not remain stationary at the point of development and will not burn a hole. Rather the arc will migrate along the contact surfaces and will not unduly heat anyone spot. Damage is avoided or at least minimized by such a provision.

In lieu of the two small permanent magnet rods 26, 27, one can construct rod 13 as permanent magnet. Still alternatively, if the rod 13 is made of soft magnetic material, stray and leakage flux can be put to use and is appropriately run into such rod to obtain the same effect of moving an arc over the contact surfaces.

Owing to the relatively large cross-section of the yokes and of the armataure made possible by the construction and technique of the invention, permanent magnets do not produce any detrimental effects on the contact actuating members in respect of a too rapid saturation of the flux path provided for the adhesion of the pivotal armature and for the actuation thereof.

The magnetic action of the permanent magnets or of analogous magnetization as setting up a magnetic blowing field along the contact surfaces (which is the direction of perspective foreshortening in the perspective view), is supplemented by an air blowing action resulting from the following.

As stated above, yokes as well as armature and also the laterally extending contact carriers 10 and 11 are of flat, wide construction. Bearing in mind that these contact carriers are moving inside of the gap as set up by wide vertically facing yoke arms, e.g. 1*a*, 2*a*, it appears that upon contact actuation rather large quantities of air are being displaced. That gap is now to be closed laterally by foils such as 40 along the outside of the assembly as well as by a foil on the inside of the yoke assembly having also, in the drawing, vertical extension and laterally closing off the gap spaces between those yoke legs (between which the carriers 10 and 11 move). The inside foils will respectively extend on one side each right next to the armature 7 and where reaching into that gap space and on the respective other sides to the corner pieces. This way the inside foils face individually carriers 10 and 11.

If the carriers 10 and 11 are about as wide as the yoke legs, then the air flows e.g. from above the armature and the carriers in opposite directions along but underneath yoke arm 2*a;* assuming, of course, that this end of the armature moves up. Considering more closely carrier 11, air will flow across contact surface 14 towards and around end 11*a* to the space below (see arrow 41). The air will then flow along yoke leg 1*a* and below the carrier 11 towards the armature. The airflow around carrier 10 is symmetrical thereto. In the case of armature actuation in the opposite direction, the airflow will reverse accordingly and will run always predominantly along the yoke legs and carriers. Specifically, then, the airflow above and below the contact carrier runs predominantly along the yoke extension, transverse to the cylinder axis as defined by the cylindrical contact surface portion of contacts 16 and here particularly across the line along a contact 16 that has just been opened as well as across the line on contact 15 which was just engaged therewith. This airflow runs also transverse to the magnetic blowing field as resulting from the magnets 26, 27. Some air will also flow down along these foils, such as 40, but the foils impede significantly any significant flow, which bypasses the just disengaged contact surfaces. The main airflow will have a definite component in the stated direction, whereby on the side of the carrier (upper or lower as the case may be) carrying the contact surface (14 and 15) being subject to contact opening, air will always be blown towards the armature across the respective surface, transverse to the direction of magnetic blowing.

The blowing dilutes any air and cools the contact surfaces which is beneficial for the life of the relay and avoids undue or premature burning. The air pumping action is supplemented by the springs 17 and 18 for the following reasons. As the contact carriers and armature have, for example, a down position, spring 17 is deflected down. These springs 17 and 18 are also rather wide. If the armature pivots, so that the contact carriers are moved up, the contact 16 on the deflected spring 17 does not yet disengage from the carrier contact, so that the air space does not yet participate significantly in an air compensating flow. The still closed contacts on that side serve also as a barrier against any flow around e.g. the end 11a of carrier 11. The air above is thus slightly compressed as carrier 11 moves towards flat spring 18. Thus, as soon as contact 16/15 opens, a rather strong airflow is induced around end 11a and across surface 15 as just receding from contact 16 on spring 17, forcefully blowing against any arc in transverse direction as it migrates along contact 16 under magnetic blowing action as described.

The invention is not limited to the embodiments described above, but all changes and modifications thereof not constituting departures from the spirit and scope of the invention are intended to be included.

I claim:

1. In an electromagnetic relay having at least one movable contact on an armature and cooperating with at least one stationary contact, the improvement comprising at least one of the contacts constructed and contoured to have curved cylindrical surface contour, so that the contacts make contact along a line of contact closing only, extending transversely to the direction of movement of the movable contact, when the relay is actuated; and means for generating a magnetic flux extending transversely to the said direction of movement of the contacts as well as transversely to said line and parallel to and in the vicinity of the contact surfaces, so that any arc is forced along said line following opening of the contacts and for at least a period during which the movable contacts are being moved.

2. An electromagnetic relay as claimed in claim 1, and including means for conducting the magnetic flux from the armature to said contact on the armature, the flux extending perpendicularly to the line of contact making.

3. An electromagnetic relay as in claim 1, wherein the means include at least one permanent magnet on a carrier for the moving contacts for producing the magnetic flux.

4. In an electromagnetic relay having a swivel armature having an end that moves in one or the opposite direction upon energization of the relay, the combination comprising:

a flat contact carrier extending from said armature end, moving therewith and including magnetic conductive means;

a contact on said carrier moving therewith in one or the opposite direction;

a stationary contact disposed and constructed to define a line of contact closing when making contact with the contact on said carrier, said line of contact extending transversely to said direction of moving; and said magnetic conductive means providing a magnetic flux in the vicinity of said line of contact closing, transversely thereto as well as transverse to said direction of moving, so that any arc is forced along said line upon opening of the contacts.

5. In an electromagnetic relay having a movable armature, moving in one or the opposite direction upon actuation of the relay, the combination comprising:

a flat contact carrier extending from a moving end of the armature in a direction transverse to said direction of moving;

a contact on the carrier moving therewith;

a stationary contact, the contacts being constructed so that at least one of them has a cylindrical contour for making of contact between the contacts along a line, which extends parallelly to the flat contact carrier and transversely to said direction of moving; and means for providing a magnetic flux transverse to both, said direction of moving and said line of making contact to cause any arc to move along said line upon opening of the contacts.

6. In an electromagnetic relay, having an armature with at least one end moving in one or the opposite direction upon energization of the relay, the combination comprising:

a flat contact carrier extending from the armature and having two narrow sides extending away from the armature and a narrow end joining the sides opposite the armature;

a contact on said carrier extending parallel to said end and moving therewith;

a stationary contact, the contacts having contour of at least one convex cylindrical surface, so that they make contact along a line;

means for confining an air-space around said contacts, so that upon movement of the contacts away from each other air is moved across the contact carrier, transverse to the line of contact and around said end; and means for providing magnetic blowing action along said line of contact making and transverse to said direction of contact moving to move an arc developing between the contacts along a path of minimum distance between the contacts in any instant, the air flowing transversely to the movement of the arc.

7. In an electromagnetic relay having at least one movable contact on an armature and cooperating with at least one stationary contact, the improvement comprising:

at least one of the contacts constructed and contoured to have curved cylindrical surface contour, so that the movable contact and the stationary contact make contact along a line of contact closing only, said line extending transversely to the direction of movement of the movable contact when the relay is actuated;

means for generating a magnetic flux extending transversely to the said direction of movement of the contacts as well as transversely to said line and parallel to and in the vicinity of the contact surfaces, so that any arc is forced along said line following opening of the contacts and for at least a period during which the movable contacts are being moved; and means for producing an airflow across said line for cooling and thinning the plasma as developed between the opening moving and the stationary contact.

8. An electromagnetic relay as in claim 7, wherein the moving contacts are mounted on a carrier being constructed to be sufficiently broad and being arranged together with the stationary contact, so that motion of the moving contact produces the airflow across said line for the cooling and the thinning of the plasma.

9. An electromagnetic relay as in claim 8, wherein the contact carrier is rigidly connected to the armature, and means to close the air space above and below the armature end and the contact carriers.

10. An electromagnetic relay as in claim 9, wherein the air spaces above and below the armature end carrying the contact carrier as well as above and below the carrier are substantially closed on all sides with the exception of one side in such a way that armature motion permits airflow between top and bottom of the armature and of the contact carrier to take place substantially only on the one free side of the latter.

11. An electromagnetic relay as in claim 10 wherein the longitudinal extension of elongated contacts extends in the direction of the side which is left free for air compensation.

12. In an electromagnetic relay having a movable armature, moving in one or the opposite direction upon actuation of the relay, the combination comprising:

a flat contact carrier extending from a moving end of the armature in a direction transverse to said direction of moving;

a contact on the carrier moving therewith;

a stationary contact, the contacts being constructed so that at least one of them has a cylindrical contour for making of contact between the contacts along a line, which extends parallelly to the flat contact carrier and transversely to said direction of moving of the contacts; and means for confining an air space adjacent to said contact, above and below of said carrier as well as to those sides of the carrier respectively in front of and behind the line and the direction of arc movement, but leaving space at a transverse carrier end to obtain an air-flow transversely to said line and around said end of the carrier opening of the contacts, the contacts as well as the carrier having at least approximately similar dimensions in the direction of said line.

* * * * *